US005381737A

United States Patent [19]

Trenary

[11] Patent Number: 5,381,737

[45] Date of Patent: Jan. 17, 1995

[54] RAIL TRUCK SUSPENDED CAR TRANSIT VEHICLES

[76] Inventor: Bryant Trenary, 3310 Fairmount 9E, Dallas, Tex. 75201-1232

[21] Appl. No.: 66,497

[22] Filed: May 25, 1993

[51] Int. Cl.[6] ..... B61C 13/00

[52] U.S. Cl. ..... 105/34.1; 105/157.1; 105/215.1; 105/133; 105/30; 105/75; 105/156; 105/148; 104/89; 104/243; 104/246

[58] Field of Search ..... 104/89, 94, 139, 243, 104/245, 246, 247; 105/30, 75, 148, 154, 73, 157.1, 215.1, 133, 34.1, 75, 156

[56] References Cited

U.S. PATENT DOCUMENTS

| | | | |
|---|---|---|---|
| 520,163 | 5/1894 | Korff | 104/246 |
| 715,791 | 12/1902 | Happe | 104/243 |
| 977,370 | 11/1910 | Carr | 104/94 |
| 2,709,968 | 6/1955 | Cox | 105/30 |
| 3,198,140 | 8/1965 | Chadenson | 104/94 |
| 3,543,687 | 12/1970 | Ellzey | 105/154 |
| 3,631,807 | 1/1972 | Cherto | 104/94 |
| 3,817,186 | 6/1974 | Walsh | 104/243 |
| 4,314,512 | 2/1982 | Gerhard et al. | 104/89 |
| 5,241,911 | 9/1993 | Luck et al. | 104/89 |

FOREIGN PATENT DOCUMENTS 0148276 12/1920 United Kingdom ..... 104/246

OTHER PUBLICATIONS

"French Suspension Railway", The Engineer, pp. 755–756, Apr. 20, 1960.

*Primary Examiner*—Mark T. Le

*Attorney, Agent, or Firm*—Richards, Medlock & Andrews

[57] ABSTRACT

A rail truck for use in an elevated closed beam having a slot in the bottom surface for clearance of a car body support member. The passenger car body is hung beneath the beam and elevated above the ground with the trucks running inside the beam. The flanged wheels run on a pair of parallel rails with an electric power rail located above the center of the two running rails. The suspension permits restrained swinging of the passenger car in the lateral and longitudinal directions. A safety wheel is mounted to the frame to prevent upward movement of the frame to the extent that the wheel flanges on the running rails could climb over the top of the running rails. A pair of auxiliary climbing rails are mounted parallel to the power rail and above the running rails. Auxiliary climbing wheels on the truck are mounted on actuators which permit a controlled elevation of the auxiliary climbing wheels.

1 Claim, 4 Drawing Sheets

RAIL TRUCK SUSPENDED CAR TRANSIT VEHICLES

FIELD OF THE INVENTION

The present invention relates to a rail truck for a suspended car rail transportation system. More specifically, the present invention relates to a means of preventing derailment of the truck by external forces acting upon the truck and to provide additional tractive capability for ascending and descending steeper grades than are normally attainable by steel wheel on steel rail vehicles.

PRIOR ART

Operation of a high speed suspended car rail system running on two rails is not described in the United States patent files. Rubber tired versions of suspended car systems using both solid and inflated tires have been built in the past. Single supporting rail suspended monorail systems have been built in the past. The potential of high speed operation requires that the attitude of the cars be securely controlled and derailment of the trucks carrying the cars be prevented. The inhibiting of vibration caused by the natural frequency of the cars and guideway being excited by car movement cannot be attained in rubber tired cars because elastomeric tires cannot dampen out the forces. Unattenuated vibration creates noise and causes metal fatigue in structures.

SUMMARY OF INVENTION

The principal objective of the present invention is to provide a truck, or bogie, that can operate inside a closed horizontal beam having a slot in lower surface for the car body support, that will eliminate the possibility of derailment of the truck due to forces acting upon the truck. A very high speed, 150 MPH to 200 MPH, operation will be affected by air currents caused by movement of the vehicle and surface winds. The forces from these air currents cannot be permitted to raise the light weight suspended cars to the extent that the flanged wheels can climb over the rails in the lateral direction.

It is also an objective of the present invention to provide a truck that can exert a greater normal force on the running rails to increase the traction available to ascend or descend steeper grades than can be safely ascended or descended relying on the force provided by the weight of the car and truck assembly alone. This added tractive capability will permit steel wheel cars on steel rails to safely negotiate the grades commonly encountered in major thoroughfares built for pneumatic tired vehicles.

The foregoing objectives can be accomplished by using an electric power delivering third rail inside the beam, mounted above the center of the two running rails, as an inverted third running rail with an insulated wheel running against this third rail effectively capturing the truck in the triangle formed by the three rails. The second objective of increasing the gradability of the truck is accomplished by using an actuator to force the auxiliary climbing wheels against the auxiliary climbing rails creating a downward force on the truck and running wheels providing for additional traction between a smooth steel wheel on a smooth steel rail.

When the transit system is a slow speed automated people mover the functions of the two listed objectives can be combined into one arrangement which uses the anti-derailment wheel as a vertically movable wheel to exert additional vertical reactive force on the two running rails.

DETAILED DESCRIPTION

Figure 1:
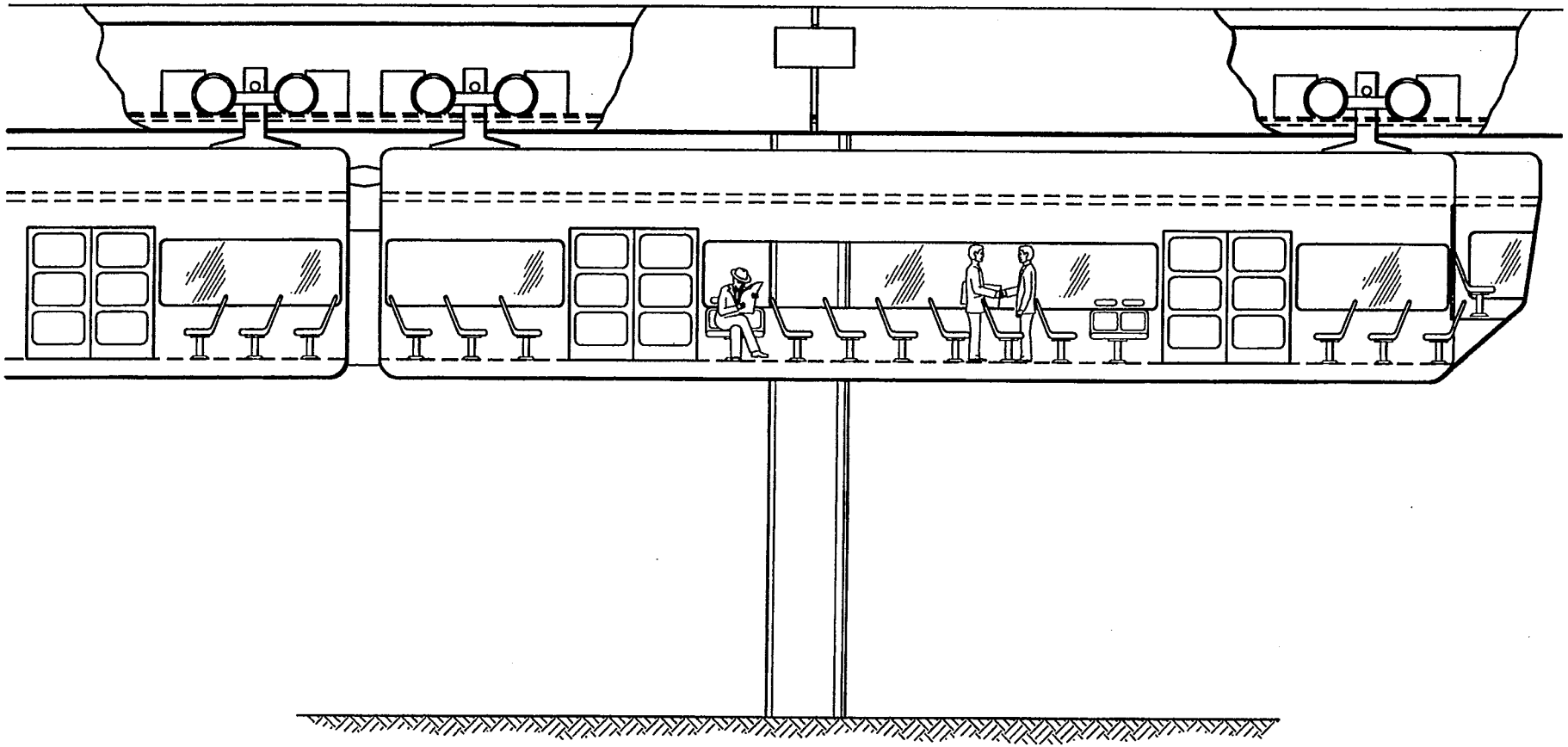
FIG. 1. is a pictorial view of the suspended transit cars that have (2) two,axle trucks running inside the horizontal beam.

As shown in the drawings the suspended car transit system will be elevated above the surface traffic in an unrestricted space which will permit very high rates of speed and acceleration. This unrestricted path permits the use of light weight composite materials in construction of the car bodies. This light weight means the cars will be affected by aerodynamic forces to a greater extent than heavier steel cars. A means of holding the cars to their trajectory in the environment of turbulent air currents is required for higher speeds possible with the suspended car transit applications. The vertical hydraulic suspensions permit the car to execute a limited lateral movement responding to centrifugal force in a high speed turn. As the track returns to a straight trajectory the car returns to the normal vertical position. This movement provides the maximum level of comfort for the passengers.

FIG. 1. shows the overall arrangement of a suspended car operation.

Figure 2:
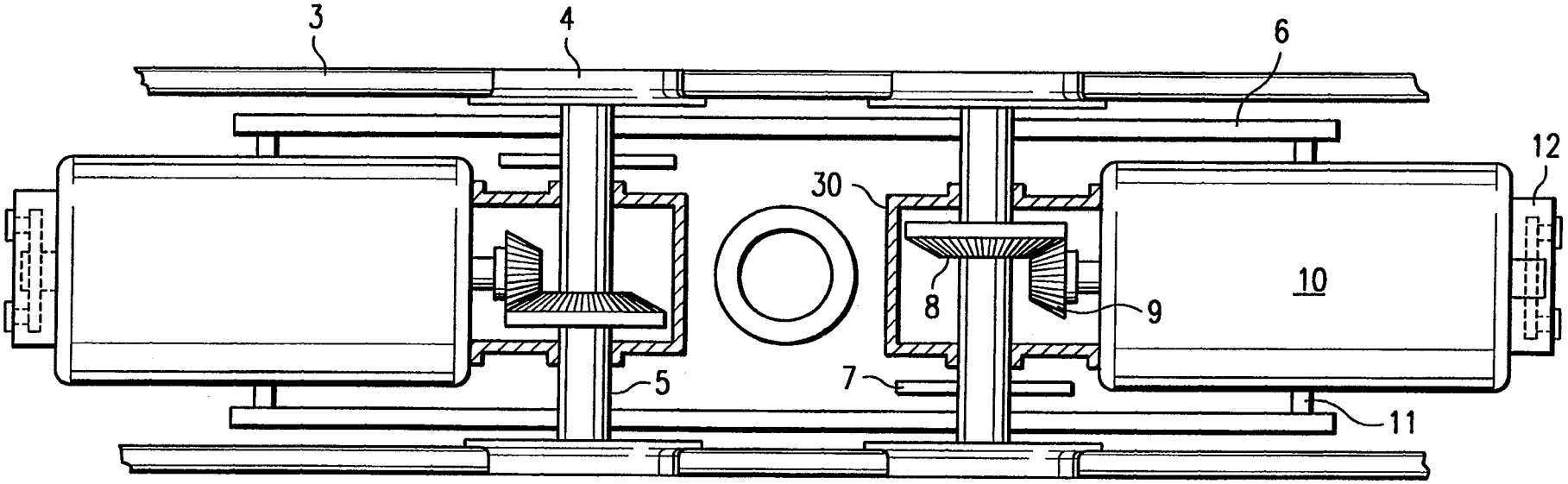
FIG. 2. is a top view of some principal mechanical components of the truck.

FIG. 2. shows the general layout of the basic mechanical components, the running wheels (4) on the two running rails (3) with the axle (5) mounted driven gear (8) and disk (7) for caliper brakes. The driving gear (9) is mounted on the output shaft of the electric motor (10) with the gear case (30) used to attach the driving end of the motor to the driven axle. A spring actuated hydraulically released parking brake (12) is mounted on the tail end shaft of the motor (10).

Figure 3:
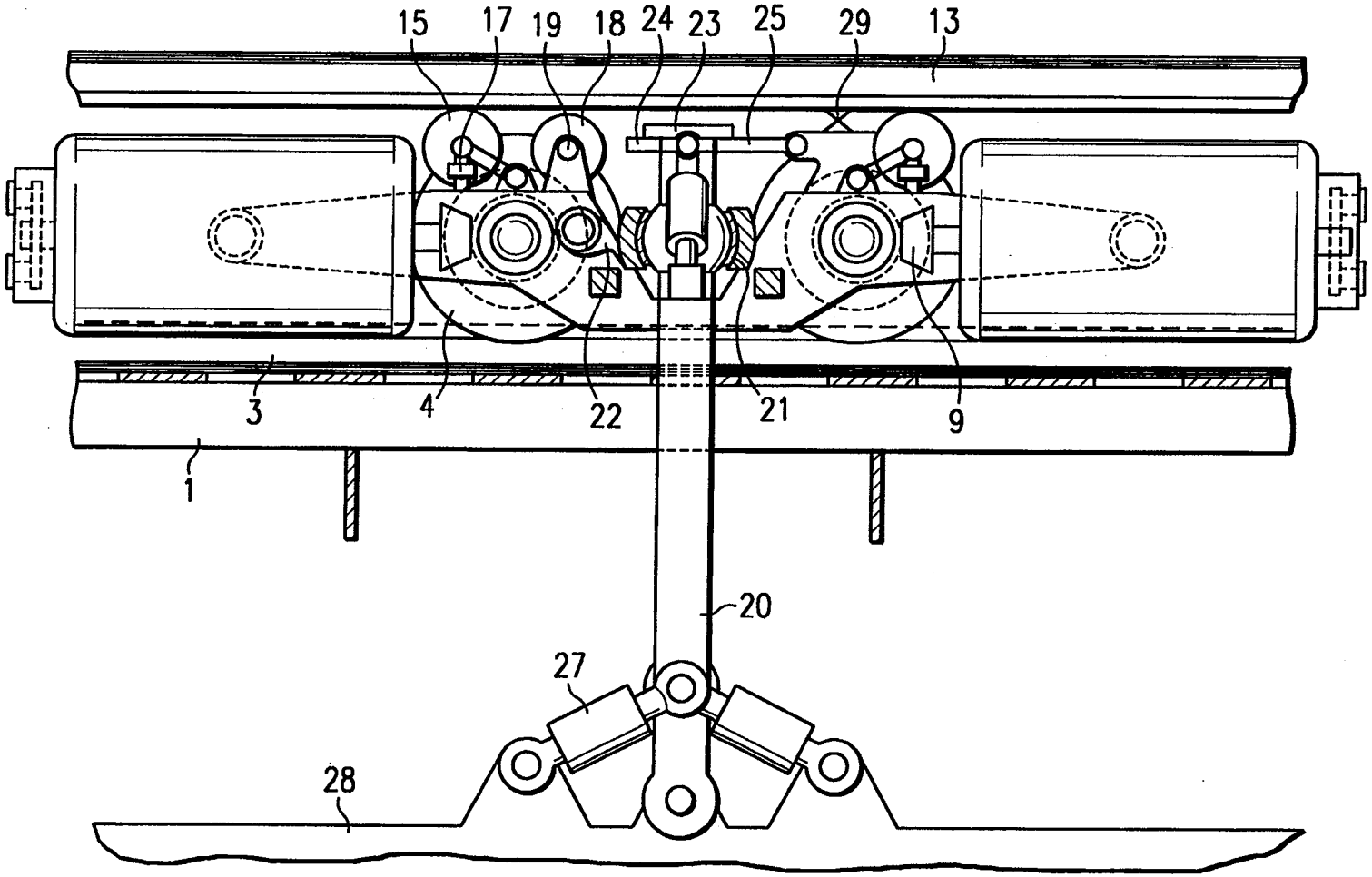
FIG. 3. is a side view of the truck.

FIG. 3. shows the auxiliary climbing wheels (15) that can be raised by the climbing wheel actuators (17) to create a reaction force at the running rail/running wheel interface which adds to the force on the running rails created by vehicle weight. The hard mounted safety wheel (18) clears the power rail by less than one-half inch. Upward movement of the truck will cause the safety wheel to contact the power rail before the running wheel flanges can clear the running rail to create a derailment. The car support shaft (20) has a shaft mounted thrust bearing (23) on the upper end which rests in a thrust bearing support (24). The thrust bearing support anti-rotation arm (25) keeps the thrust bearing support.(24) from turning as the truck rotates relative to the car support shaft (20). The lower end of the car support shaft (20) is pinned to the car body (28), and the longitudinal shock absorber (27) permits limited movement of the car body (28) relative to the truck. The current collection shoe (29) slides along the power rail (13) as the electrical contact for one side of the direct current power system. The wheels (4) contacting the rails (3) provide the other side of the direct current power delivery.

Figure 4:
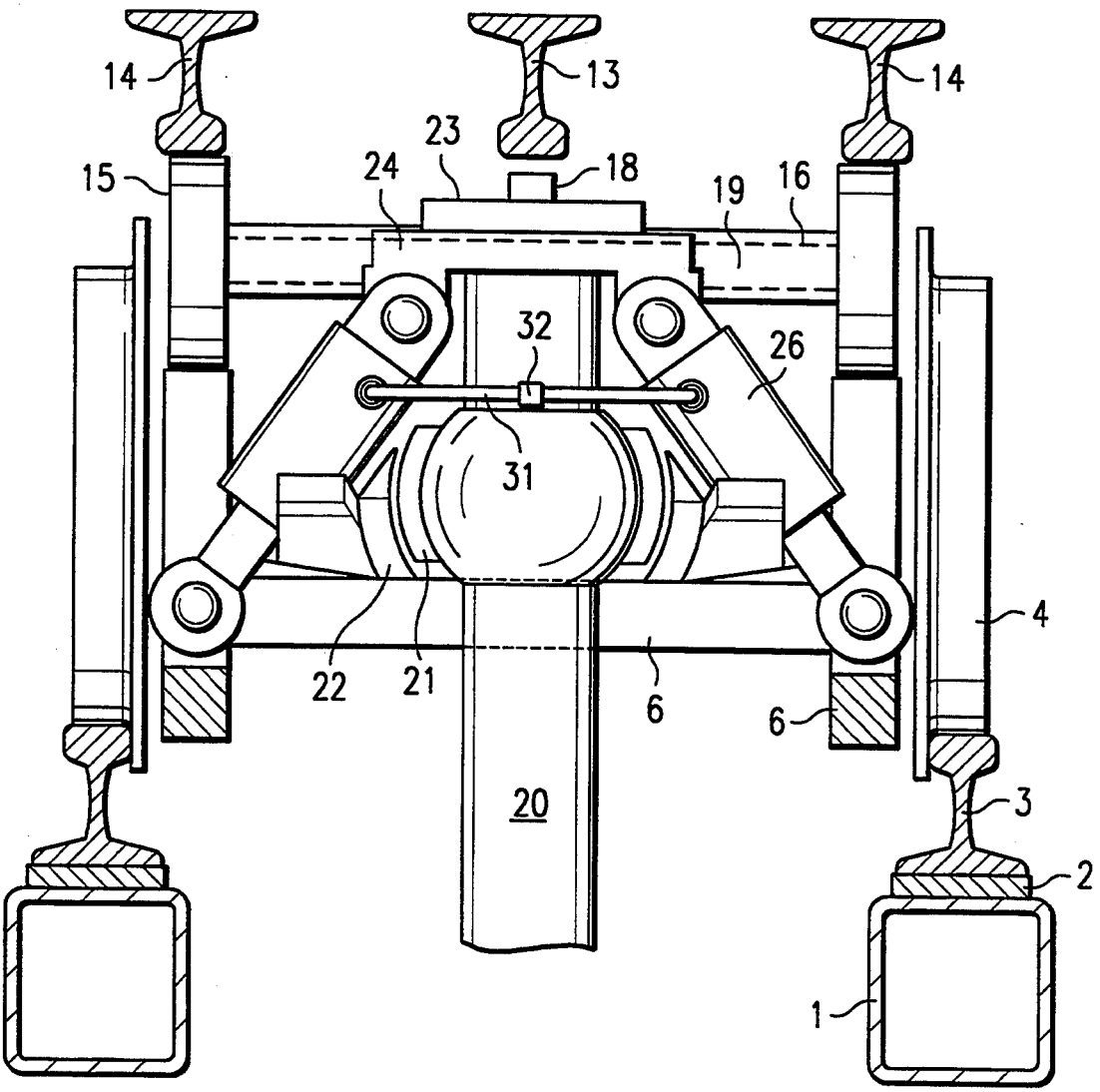
FIG. 4. is an end view of the truck.

FIG. 4. shows the rail support beam (1), the rail pad (2), and the running rail (3) which supports the running wheels (4). The truck frame (6) has the lower end of the vertical hydraulic suspension (26) attached. The upper end of the vertical hydraulic suspension (26) is attached to the thrust bearing support (24). The spherical portion of the car support shaft (20) is captured in the spherical bearing (21) which is held by the spherical bearing housing (22). The spherical bearing housing is hinged to the frame (6) so that the horizontal position of the spherical portion of the car body support shaft (20) is restricted in horizontal movement. The auxiliary climbing wheels (15) will be raised to contact the climbing rails when moved up by the actuators. The safety wheel (18) rides slightly below the power rail (13) when the running wheels are in contact with the running rails (3). The auxiliary climbing wheel axle (16) conceals the safety wheel shaft (19) in this view. The interconnecting line (31) between the two vertical load hydraulic suspensions (26) has a flow control (32) in the fluid path to control the roll rate and oscillation of the suspended cars.

What is claimed is:

1. A rail truck assembly, comprising:

(a) a first running rail and a second running rail running parallel to each other above ground and spaced apart side to side;

(b) a power rail running at a generally constant distance above the first and the second running rails, the power rail conductive to electricity;

(c) a first wheel disposed on the first running rail for rolling along the top of the first running rail, the first wheel having a hub, a circumferential surface for rolling contact along the first running rail, and a circumferential flange extending in the radial direction beyond the circumferential surface and alongside the first running rail;

(d) a second wheel disposed on the second running rail for rolling along the top of the second running rail, the second wheel having a hub, a circumferential surface for rolling contact along the second running rail, and a circumferential flange extending in the radial direction beyond the circumferential surface and alongside the second running rail;

(e) a first axle with a first end connected at the hub of the first wheel and a second end connected at the hub of the second wheel;

(f) a truck frame mounted on the axle such that the axle rotates independently of the truck frame;

(g) a driving gear rotatively connected to the axle such that rotation of the driving gear rotates the axle and the first and second wheels to roll along the first and second running rails;

(h) an electrical motor mounted to the truck frame and operatively connected to the driving gear for rotating the driving gear;

(i) a current collection shoe with one end in sliding contact with the power rail and another end electrically connected to the motor so that electricity can be conducted through the power rail to the shoe to the motor;

(j) a safety wheel rotatably mounted to the truck frame at a fixed point relative to the first and second wheels and beneath the power rail such that the distance between the top of the safety wheel and the power rail is less than the distance that the circumferential flanges extend beyond the circumferential surfaces of the first and second wheels such that the safety wheel will contact the power rail before the circumferential flanges can clear the first and second running rails;

(k) a car support shaft with an upper end mounted to the truck frame and a lower end opposite thereto; and (l) a car body connected to the lower end of the car support shaft;

(m) a first climbing rail running at a generally constant distance above the first running rail and fixed relative to the first running rail;

(n) a second climbing rail running at a generally constant distance above the second running rail and fixed relative to the second running rail;

(o) an actuator with a first end connected to the truck frame and a second end opposite thereto;

(p) a climbing wheel axle extending perpendicular to the first and second climbing rails and being rotatably connected to the second end of the actuator such that the axle can rotate relative to the actuator;

(g) a first climbing wheel with a hub mounted to one end of the climbing wheel axle and having a circumferential surface disposed underneath the first climbing rail;

(r) a second climbing wheel with a hub mounted to the other end of the climbing wheel axle and having a circumferential surface disposed underneath the second climbing rail; and (s) the actuator oriented to be able to force the first and the second climbing wheels upwards in rolling contact against the first and second climbing rails to increase the normal force between the first and second wheels and the first and second running rails, respectively.

* * * * *